US012349771B2

(12) United States Patent
Murrell et al.

(10) Patent No.: US 12,349,771 B2
(45) **Date of Patent: *Jul. 8, 2025**

(54) BABY ONESIE HAVING ZIPPER LOCKING MECHANISM

(71) Applicants: Crystal Murrell, Alexandria, VA (US); Tyler Murrell, Alexandria, VA (US)

(72) Inventors: Crystal Murrell, Alexandria, VA (US); Tyler Murrell, Alexandria, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/221,221

(22) Filed: Jul. 12, 2023

(65) Prior Publication Data

US 2023/0354967 A1 Nov. 9, 2023

Related U.S. Application Data

(63) Continuation of application No. 17/145,316, filed on Jan. 9, 2021, now Pat. No. 11,737,524.

(51) Int. Cl.
*A44B 19/30* (2006.01)
*A41D 11/00* (2006.01)

(52) U.S. Cl.
CPC ..... *A44B 19/305* (2013.01); *A41D 11/00* (2013.01); *A44B 19/301* (2013.01)

(58) Field of Classification Search
CPC ..... A41D 11/00; A44B 19/305; A44B 19/301; A41B 13/005
See application file for complete search history.

(56) References Cited

U.S. PATENT DOCUMENTS 247,824 A * 10/1881 Hinrichs et al. ..... F23D 3/00 431/309
1,014,834 A 1/1912 McDuff
1,213,954 A 1/1917 Roney
1,789,422 A 1/1931 Askey et al.
2,178,777 A 11/1939 Chapel
(Continued)

FOREIGN PATENT DOCUMENTS

WO WO-2005046381 A1 5/2005
WO WO-2022010695 A2 * 1/2022

OTHER PUBLICATIONS

How To, "How to Use Rubber Bands To Stop A Zipper from Unzipping Itself", Online Video Clip. YouTube. (Jan. 18, 2018) 6 pp. Web. https://www.youtube.corn/watch?v=PNEdG2bJ6kc (Year: 2018).

*Primary Examiner* — Alissa L Hoey
*Assistant Examiner* — Akwokwo Olabisi Redhead
(74) *Attorney, Agent, or Firm* — NIXON PEABODY LLP; David May; Sorinel Cimpoes

(57) ABSTRACT

A baby onesie to be worn by a baby includes body covering material configured to cover a body of the body, the body covering material including an opening through which the baby's head can protrude out from, a neckline provided around a perimeter of the opening, the neckline including a neckline fastener configured to be fastened and unfastened to thereby close and open the neckline, respectively, a zipper configured to open and close the body covering material, and a zipper locking mechanism attached to the zipper, the zipper locking mechanism configured to selectively attach to the neckline fastener and thereby lock the zipper in place according to whether the neckline fastener is fastened or unfastened.

29 Claims, 11 Drawing Sheets

(56) References Cited

U.S. PATENT DOCUMENTS 2,579,276 A * 12/1951 Schworm, Jr. ..... A41B 13/06 24/387
2,615,165 A 10/1952 Steedman
2,680,849 A 6/1954 Munro
3,255,503 A * 6/1966 Sozzi ..... A44B 19/301 24/387
3,430,264 A 3/1969 Beukenkamp, Jr.
4,575,873 A 3/1986 Smith
4,648,137 A 3/1987 Cooper
5,274,853 A 1/1994 Millican
5,418,979 A 5/1995 Senderowicz
5,586,368 A 12/1996 Nelson
5,692,240 A 12/1997 Steele
5,845,335 A 12/1998 Twitty
6,722,544 B1 4/2004 Stephens et al.
7,200,901 B2 4/2007 Pitts et al.
7,305,717 B1 * 12/2007 Brown ..... A41D 13/1272 2/269
8,157,140 B2 * 4/2012 Jay ..... A45F 5/02 224/269
8,448,264 B2 * 5/2013 Ellsworth ..... A41D 3/00 2/96
8,522,410 B2 9/2013 Parisi et al.
8,533,918 B1 * 9/2013 Ketter ..... A44B 19/301 24/429
9,289,084 B1 3/2016 McKeown
9,739,076 B2 8/2017 Dunn
2006/0218754 A1 10/2006 Dobson
2007/0061966 A1 3/2007 Seth
2009/0222968 A1 9/2009 Pisano-Ginter
2009/0293169 A1 12/2009 Wise
2012/0079645 A1 4/2012 Carlson
2012/0110716 A1 5/2012 Christensen et al.
2012/0151654 A1 6/2012 Chopak et al.
2013/0185841 A1 7/2013 Berkowitz et al.
2013/0298304 A1 11/2013 Ott et al.
2015/0265006 A1 9/2015 Weller
2015/0289575 A1 10/2015 Krautner
2018/0042310 A1 2/2018 Mortimer
2018/0049480 A1 2/2018 Fay et al.
2019/0208831 A1 7/2019 Joshi
2020/0268067 A1 8/2020 Curtiss

* cited by examiner

BABY ONESIE HAVING ZIPPER LOCKING MECHANISM

CROSS-REFERENCE TO RELATED APPLICATIONS

This application is a continuation of U.S. application Ser. No. 17/145,316 filed Jan. 9, 2021 and entitled "BABY ONESIE HAVING ZIPPER LOCKING MECHANISM."

BACKGROUND

1. Field

Exemplary embodiments disclosed herein relate to a baby onesie having a zipper locking mechanism, and more particularly, relate to a baby onesie having a zipper locking mechanism that locks a zipper to a neckline fastener of the baby onesie.

2. Description of the Related Art

A popular item of clothing for babies is a baby "onesie" (also referred to as a baby "jumpsuit" or a baby "bodysuit"), which is a garment made of a single piece of material that includes leg covering portions (pant legs) which cover the baby's legs, a torso-covering middle section which covers the baby's torso, and arm covering portions (sleeves) which cover the baby's arms. The onesie typically includes an opening and closing mechanism, such as a zipper or a series of buttons, that extends from the neckline region to the bottom of one of the leg regions and is used to open and close the onesie to put the baby into and take the baby out of the onesie. The opening and closing mechanism is typically provided along the front of the onesie, although may alternatively be provided along the back or the side of the onesie.

Parents may prefer dressing their babies in onesies instead of multiple-piece outfits, such as pants and a separate shirt, for several reasons. First, since the onesie is a single continuous piece of material from the neckline down to the feet, the onesie ensures that the baby's body is covered at night, thereby keeping the baby warm and safe from external elements (e.g., bugs). In contrast, a multiple-piece outfit may expose parts of the baby's body, such as the stomach and back region. Second, parents typically find it much easier to change a baby into a onesie, because the parent can simply lay the onesie on a changing table, lay the baby on top of the onesie such that the baby's legs enter the leg covering portions, pull the baby's arms through the arm holes, and then close the onesie. In contrast, parents often need to exert significantly more effort to change a baby into a multiple-piece outfit. For example, a parent dressing his or her baby into a shirt and separate pants outfit may need to first sit the baby upright on a changing table, then pull the baby's head through the top of the shirt, then pull each of the baby's arms through the shirt arm holes, then lay the baby down on the baby's back, then pull each of the baby's legs through the foot holes at the bottom of the pants, and then stand the baby back up or pick the baby up and finish pulling the pants all the way up into place.

Nevertheless, although the onesie design has several advantages over the multiple-piece outfit design, a problem with onesies is that a baby may figure out how to unzip his or her onesie, thus leaving the baby vulnerable and cold.

US 2013/0298304A1 to Ott et al. discloses an infant garment that includes a protective flap 64 that covers a zipper pull tab 28. The protective flap 64 has a snap stud 70 that engages with a snap socket 68 to secure the protective flap 64 to the garment 10. However, the protective flap 64 does not actually lock the zipper pull tab 28 in place, but rather, simply covers the zipper pull tab 28. Thus, the protective flap 64 disclosed by Ott does not prevent an infant from reaching the zipper pull tab 28 and pulling open the garment 10. Moreover, the protective flap 64 could easily be unsnapped by an infant.

US 2020/0268067 A1 to Curtiss is directed towards a garment for infants, toddlers and children, which includes a locking device for securing a zipper slider 8 in a closed position. The locking device includes a flap 16 that is snapped into place by connecting a snap 18 on the end of the flap 16 with a complimentary snap on the garment, along with a pocket 20 that can receive the zipper slider 8 and flap 16 when the zipper is in its closed position. However, the flap 16 of Curtiss could simply be unsnapped by an infant, and the pocket 20 does not actually lock the zipper into place. Moreover, the design of Curtiss is excessively complicated and impractical, and it would be difficult for a parent to insert the zipper into the pocket 20 of Curtiss, especially when tending to a fussy baby.

Thus, there is a significant need for a locking mechanism that can securely lock the zipper of a baby onesie into a closed position.

There is a further need for a locking mechanism on a baby onesie that is not overly complicated and can be quickly locked and unlocked by parents.

SUMMARY

Exemplary embodiments disclosed herein relate to a baby onesie having a secure zipper locking mechanism that securely locks a zipper into a closed position by connecting the zipper to a fastener in the neckline of the onesie.

Exemplary embodiments disclosed herein further relate to a method of manufacturing the baby onesie.

Additional aspects will be set forth in part in the description which follows and, in part, will be apparent from the description, or may be learned by practice of the presented exemplary embodiments.

According to an aspect of an exemplary embodiment, there is provided a baby onesie to be worn by a baby, the baby onesie including: body covering material configured to cover a body of the body, the body covering material including an opening through which the baby's head can protrude out from; a neckline provided around a perimeter of the opening, the neckline including a neckline fastener configured to be fastened and unfastened to thereby close and open the neckline, respectively; a zipper configured to open and close the body covering material; and a zipper locking mechanism attached to the zipper, the zipper locking mechanism configured to selectively attach to the neckline fastener and thereby lock the zipper in place according to whether the neckline fastener is fastened or unfastened.

When the neckline fastener is fastened, the zipper locking mechanism may lock the zipper in place, and when the neckline fastener is unfastened, the zipper locking mechanism may unlock the zipper.

The body covering material may include: leg covering portions configured to cover legs of the baby; arm covering portions configured to cover arms of the baby; and a torso covering portion configured to cover a torso of the baby, the torso covering portion being connected to the leg covering portions and the arm covering portions, and including the opening.

The neckline may include: a first neckline portion configured to wrap around a majority of the baby's neck, the first neckline portion having a first thickness; and a second neckline portion connected to the first neckline portion, the second neckline having a second thickness greater than the first thickness, wherein the first and second thicknesses are measures of length along a direction which is perpendicular to the perimeter of the opening and extending down along the torso covering portion.

The neckline fastener may include: an insertion end connected to the first neckline portion, the insertion end including a protruding portion; and a receiving end at least partially enclosed within the second neckline portion, the receiving end including an opening configured to receive the protruding portion.

The neckline fastener may include a side-release buckle strap, the insertion end may include a plurality of hook portions, and the receiving end may include a housing to receive the hook portions, the housing having openings on opposite sides of the housing, wherein when the hook portions are inserted into the housing, the hook portions spring outwards through the openings to catch sidewalls of the housing and lock the insertion end to the receiving end.

The neckline fastener may include one of a swivel lobster claw clasp fastener, a button fastener, a VELCRO® strap fastener, a plurality of small hook and eye latches, or a single large hook and eye latch.

The zipper locking mechanism may include a loop of material connected to the zipper, the loop of material being configured to wrap around the insertion end when the neckline fastener is unfastened, so that, when the neckline fastener is then fastened, the loop of material locks the zipper in place.

The baby onesie may further include: a track including two strips of teeth that are configured to interlock together, the track extending from the neckline, down along the torso covering portion and ending at a foot portion of the one of the leg covering portions; and a stop provided at the foot portion, the stop being configured to stop the zipper from sliding off the track, and the zipper may include: a slider connected to the track, the slider comprising wedges that are configured to guide the teeth on one of the strips into corresponding hollows formed between the teeth on the other strip to interlock the strips together when the slider is pulled along the track.

The loop of material may be connected to the slider.

The loop of material may include rubber and the zipper slider may include rubber to thereby form a rubber zipper.

The neckline fastener may include an insertion end and a receiving end, and the neckline may include a first neckline portion configured to wrap around a majority of the baby's neck, the first neckline portion connected to one of the insertion end or the receiving end, and a second neckline portion including a VELCRO® flap configured to cover the other of the insertion end or the receiving end.

The zipper locking mechanism may include one of a swivel lobster claw clasp locking mechanism, a button locking mechanism, or a VELCRO® strap locking mechanism.

The baby onesie may further include grippy feet provided on soles of foot portions of the respective leg covering portions, the grippy feet including high-friction materials, and fold-over hands provided at ends of the respective arm covering portions, the fold-over hands including portions of material that can be folded up to expose the baby's hands and folded back down to cover the baby's hands.

The baby onesie may further include another zipper connected to the track, wherein the zipper may be configured to open the body covering material from a first end of the track, and the other zipper may be configured to open the body covering material from a second end of the track opposite the first end of the track.

According to an aspect of another exemplary embodiment, there is provided a zipper locking mechanism for a baby onesie, the zipper locking mechanism including: a neckline fastener configured to be attached to a neckline of the baby onesie, the neckline fastener further configured to be fastened and unfastened to thereby close and open the neckline, respectively; and a zipper locking mechanism configured to be attached to a zipper of the baby onesie, the zipper locking mechanism being further configured to selectively attach to the neckline fastener and thereby lock the zipper in place according to whether the neckline fastener is fastened or unfastened.

The neckline fastener may include: an insertion end configured to be connected to the neckline, the insertion end including a protruding portion; and a receiving end configured to be at least partially enclosed within the neckline, the receiving end including an opening configured to receive the protruding portion, and the zipper locking mechanism including a loop of material configured to be connected to the zipper, the loop of material being configured to wrap around the insertion end when the neckline fastener is unfastened, so that, when the neckline fastener is then fastened, the loop of material locks the zipper in place.

According to an aspect of another exemplary embodiment, there is provided a method of manufacturing a baby onesie to be worn by a baby, the method including: manufacturing a body covering material configured to cover a body of the body, the body covering material including an opening through which the baby's head can protrude out from, a neckline provided around a perimeter of the opening, and a zipper configured to open and close the body covering material; attaching a neckline fastener to the neckline, the neckline fastener configured to be fastened and unfastened to thereby close and open the neckline, respectively; and attaching a zipper locking mechanism to the zipper, the zipper locking mechanism configured to selectively attach to the neckline fastener and thereby lock the zipper in place according to whether the neckline fastener is fastened or unfastened.

The neckline fastener may include an insertion end including a protruding portion and a receiving end including an opening configured to receive the protruding portion, and the attaching of the neckline fastener to the neckline may include attaching the insertion end to a first part of the neckline and attaching the receiving end to a second part of the neckline.

The zipper locking mechanism may include a loop of material, and the attaching of the zipper locking mechanism to the zipper may include attaching the loop of material to a slider of the zipper.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Hereinafter, a baby onesie having a zipper locking mechanism according to exemplary embodiments will be described with reference to the accompanying drawings.

According to an aspect of exemplary embodiments, a zipper locking mechanism is a device that is connected to or integrally formed with a zipper, and is selectively connectable to a neckline fastener used to open and close a neckline of a baby onesie. The zipper locking mechanism according to exemplary embodiments achieves several technical benefits as compared to the related art. First, the zipper locking mechanism according to exemplary embodiments very securely locks the zipper in place, thus protecting the baby from the external elements. Second, the zipper locking mechanism according to exemplary embodiments is configured such that the zipper stays locked so long as the neckline stays closed, and conversely, the zipper is automatically unlocked in response to opening the neckline. Thus, the zipper locking mechanism is extremely efficient and practical for parents to use, because whenever a parent wants to change the baby out of the onesie, the parent can simply open the neckline to thereby unlock the zipper. As a result, the baby onesie having the zipper locking mechanism according to exemplary embodiments is more secure, more efficient, and more practical than the baby onesies of the related art.

Figure 1:
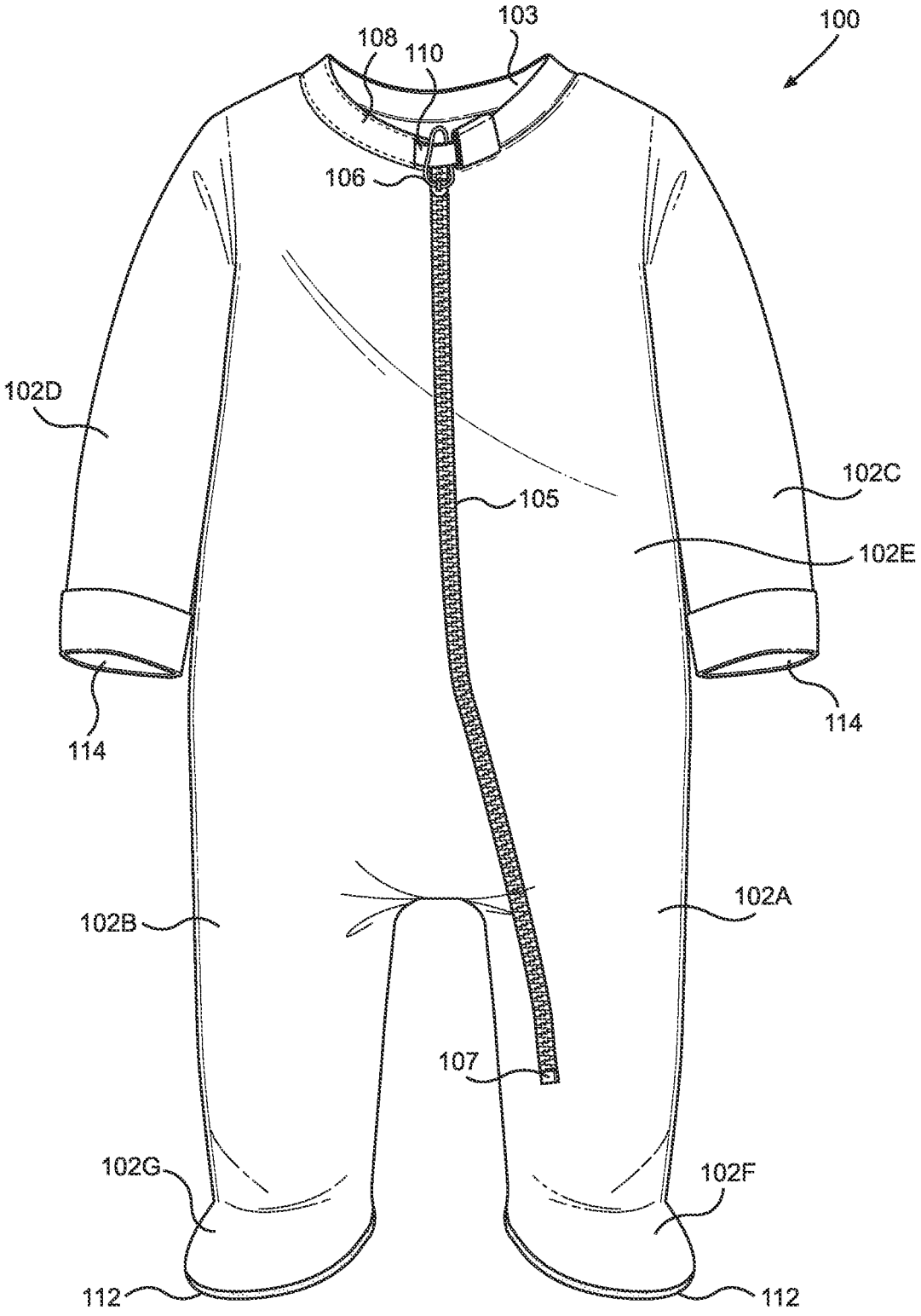
FIG. 1 is a front view of a baby onesie having a zipper locking mechanism, according to an exemplary embodiment.

FIG. 1 is a front view of a baby onesie having a zipper locking mechanism, according to an exemplary embodiment. As shown in FIG. 1, the baby onesie 100 includes a baby covering material 102 including a first leg covering portion 102A, a second leg covering portion 102B, a first arm covering portion 102C, a second arm covering portion 102D, a torso covering portion 102E, and a neckline 108 defining an opening 103, a zipper 104, a track 105, a zipper locking mechanism 106, a stop 107, a neckline fastener 110, grippy feet 112, and fold over hands 114.

The baby covering material 102 is a single, unitary piece of material that is configured to wrap around and cover the baby to keep the baby warm and provide some protection for the baby from external elements, such as cold weather, hot liquids, sharp objects, pets, bugs, and other potentially dangerous elements. Hereinafter, the baby covering material 102 is referred to as a material for "babies", but it is understood that the term "babies" is exemplary only, and the onesie according to exemplary embodiments can be used with toddlers, kindergarteners, or other age groups as well, up to and including adults. The baby covering material 102 is a garment that can be made out of many different types of material, such as cotton, polyester, twill, poplin, linen, flannel, pinpoint fabrics, wool, silk, or any other type of material or combination of materials that can be used to make garments. The baby covering material 102 can be manufactured in many different sizes and shapes.

The first leg covering portion 102A is the portion of the baby covering material 102 that is configured to wrap around and cover one of the baby's legs and is shaped like a pant leg. In FIG. 1, the first leg covering portion 102A covers the baby's left leg. To insert the baby's left leg into the first leg covering portion 102A, a parent opens the baby covering material 102 using the zipper 104 and positions the baby's left leg into the first leg covering portion 102A so that the baby's left foot is snugly fixed in the foot portion 102F. In the example shown in FIG. 1, the first leg covering portion 102A includes the foot portion 102F that wraps around and cover's the baby's foot. However, the onesie 100 is not limited to this design, and the first leg covering portion 102A can instead omit the foot portion 102F so that an opening is formed at the end thereof, in which case the baby's foot sticks out from the first leg covering portion 102A.

The second leg covering portion 102B is the portion of the baby covering material 102 that is configured to wrap around and cover the other of the baby's legs and is shaped like a pant leg. In FIG. 1, the second leg covering portion 102B covers the baby's right leg. To insert the baby's right leg into the second leg covering portion 102A, the parent positions the baby's right leg into the second leg covering portion 102A so that the baby's right foot is snugly fixed in the foot portion 102G. Similar to the first leg covering portion 102A, the second leg covering portion 102B can also omit the foot portion 102G.

The first arm covering portion 102C is the portion of the baby covering material 102 that is configured to wrap around and cover one of the baby's arms and is shaped like a sleeve. In FIG. 1, the first arm covering portion 102C covers the baby's left arm. To insert the baby's left arm into the first arm covering portion 102C, the parent typically pushes the baby's left hand into the first arm covering portion 102C and then pulls and wiggles the left hand out through the opening at the end of the first arm covering portion 102C.

The second arm covering portion 102D is the portion of the baby covering material 102 that is configured to wrap around and cover the other of the baby's arms and is shaped like a sleeve. In FIG. 1, the second arm covering portion 102D covers the baby's right arm. To insert the baby's right arm into the first arm covering portion 102D, the parent typically pushes the baby's right hand into the first arm covering portion 102D and then pulls and wiggles the right hand out through the opening at the end of the first arm covering portion 102D.

The torso covering portion 102E is the portion of the baby covering material 102 that covers the baby's torso, i.e., the midsection including the stomach, chest, and back. The torso covering portion 102E is the central part of the baby covering material 102 that connects the first leg covering portion 102A, the second leg covering portion 102B, the first sleeve 102C, and the second sleeve 102D together. To cover the baby's torso, the parent first inserts the baby's arms and legs into the first leg covering portion 102A, second leg covering portion 102B, first arm covering portion 102C, and second arm covering portion 102D as described above, and then zips up the zipper 104 so that the zipper 104 moves all the way up to the neckline 108, thereby zipping closed the baby covering material 102. The torso covering portion 102E includes an opening 103 at a top area thereof, so that the baby can stick his or her head out of the torso covering portion 102E through the opening 103.

The zipper 104 is used to close and open the baby covering material 102, to thereby dress and undress the baby in the onesie 100. According to an exemplary embodiment shown in FIG. 1, the zipper 104 may be a rubber zipper, such as a zipper completely made of rubber or a metal zipper core covered with an outer layer of rubber. The track 105 includes two strips of teeth that are configured to interlock together. To interlock, each strip of teeth includes a series of protruding portions (the "teeth") and recessed portions (also referred to as "hollows") that are arranged in between the teeth. One strip of teeth is slightly offset from the other strip of teeth such that the teeth in the one strip will fit into the hollows on the other strip, and the teeth in the other strip with fit into the hollows of the one strip. The zipper 104 includes a slider 104A that slides along the track 105. The zipper 104 is connected to or integrally formed with a zipper locking mechanism 106 that functions as both a zipper pull and a zipper lock to lock the zipper 104 to the neckline fastener 110. The slider 104A includes wedges that are configured to guide the teeth on one of the strips into corresponding hollows on the other strip, and guide the teeth on the other strip into corresponding hollows on the one strip, to interlock the strips together. The stop 107 is located at the end of track 105 at the foot portion 102F and stops the zipper 104 from sliding off the track 105.

In the exemplary embodiment shown in FIG. 1, the track 105 starts at the neckline 108, runs down the torso covering portion 102E, continues down the side of the first leg covering portion 102A, and ends at the stop 107 located near the foot portion 102F of the first leg covering portion 102A. Thus, to zip the baby onesie 100 closed, a parent will pull the zipper 104 from the foot portion 102F up along the first leg covering portion 102A, continue up the torso covering portion 102E, and finish zipping the zipper 104 up to the neckline 108. Conversely, to open the baby onesie 100, the parent will pull the zipper 104 down in the opposite direction along the track 105.

Figure 2A:
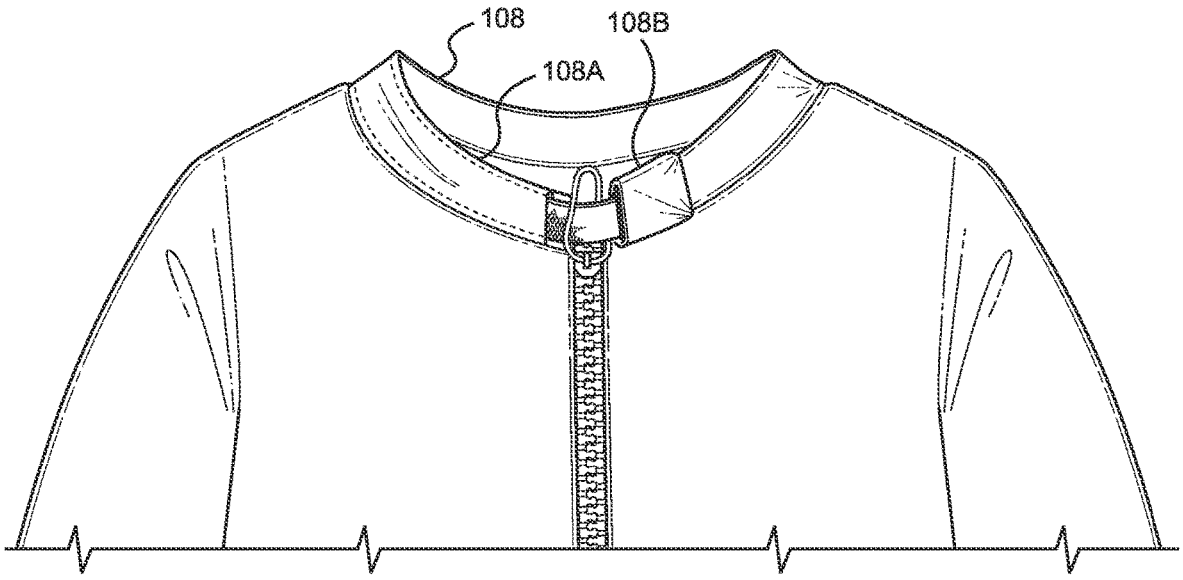
FIGS. 2A and 2B are close-up views of the neckline fastener of FIG. 1 in a fastened and unfastened state, respectively.
Figure 2B:
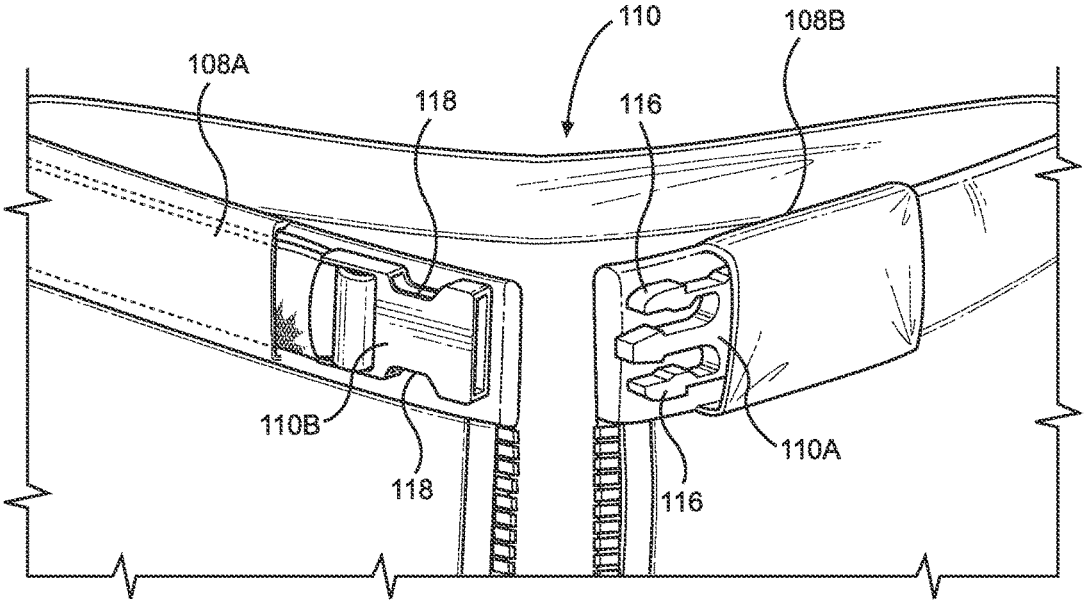
Figure 3:
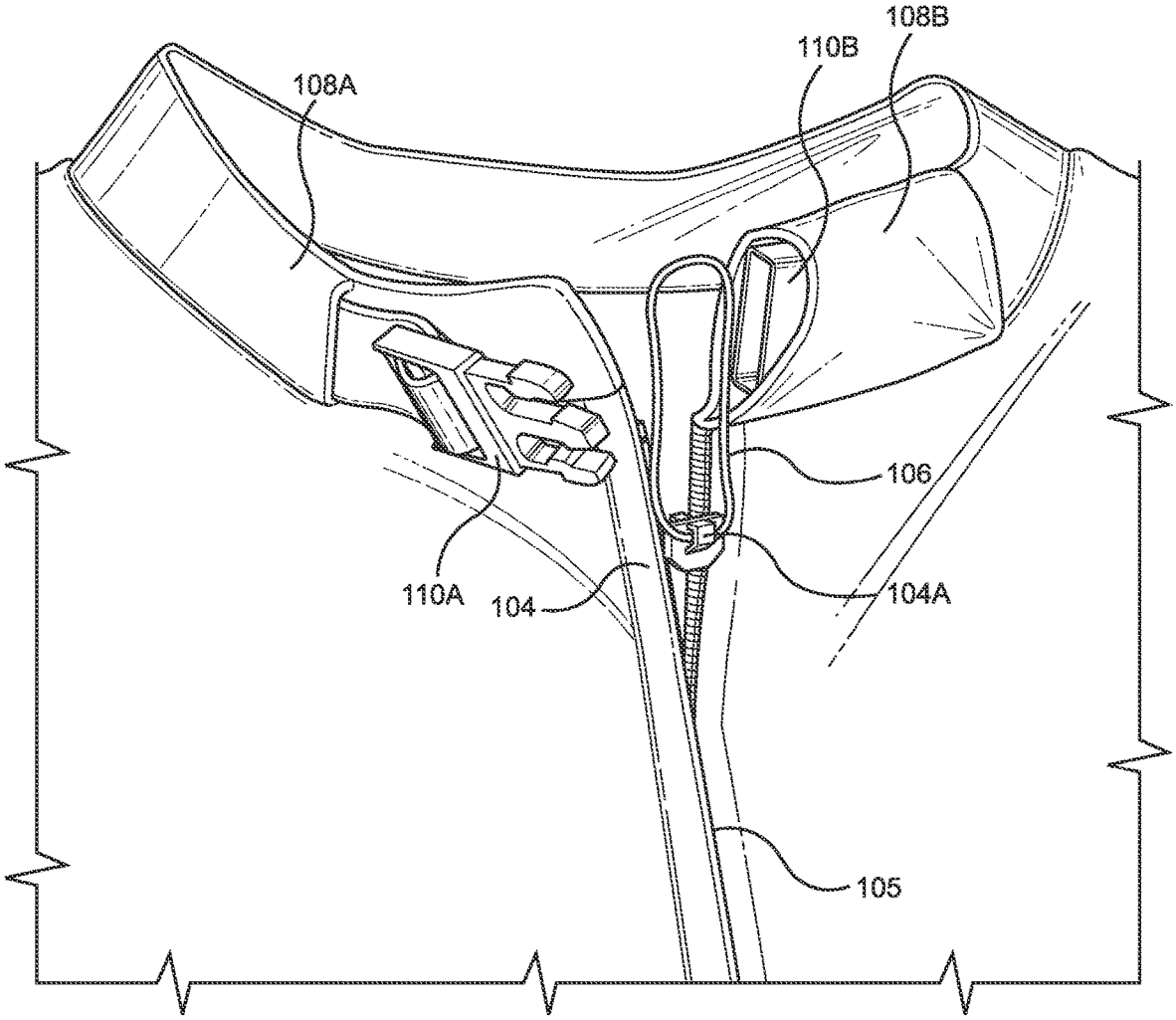
FIG. 3 is a view of the zipper locking mechanism of FIG. 1 in a state where the neckline fastener is unfastened and the zipper locking mechanism is unlocked.

The neckline 108 is the portion of the baby onesie 100 that wraps around and covers the bottom part of the baby's neck. The neckline 108 is located at the perimeter of the opening 103. The neckline 108 can be integrally formed with the baby covering material 102 (e.g., manufactured from the same piece of material), or can be a separate material that is sewn onto the baby covering material 102. As shown in FIGS. 2A and 3, the neckline 108 includes a first neckline portion 108A and a second neckline portion 108B.

The first neckline portion 108A is configured to wrap around the majority of the baby's neck. An insertion end 110A or a receiving end 110B of a neckline fastener 110 is connected to or enclosed within the first neckline portion 108A. The first neckline portion 108A has a first thickness, which is a measure of length along the direction which is perpendicular to a perimeter of the opening 103. In FIGS. 2A and 3, thickness can be measured in downward and upward directions (i.e., the downward direction which extends away from the opening 103 and down the torso covering portion 102E and the upward direction which extends upwards). Also, the thickness is not limited to only the downward and upward directions, and can include any or all of the directions extending out from a center part of the neckline portions, e.g., all radial directions extending out from the center of the neckline portions.

Figure 4:
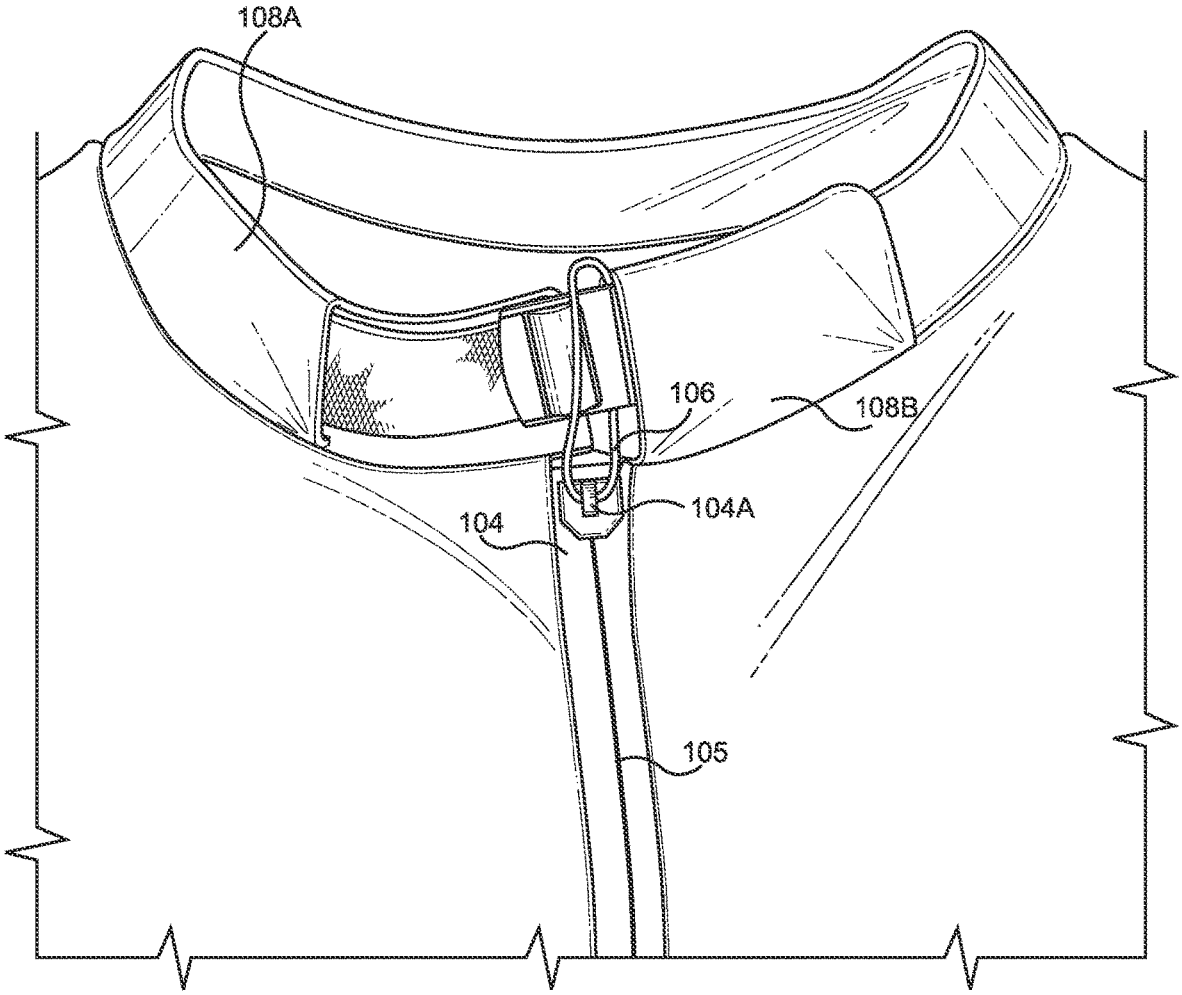
FIG. 4 is a view of the zipper locking mechanism of FIG. 1 in a state where the neckline fastener is fastened and the zipper locking mechanism is locked.

The second neckline portion 108B contacts the first neckline portion 108A when the neckline fastener 110 is fastened closed, to thereby close the neckline 108 (see FIG. 4). The second neckline portion 108B is thicker than the first neckline portion 108A, so that the second neckline portion 108B can at least partially enclose the receiving end 110B or the insertion end 110A of the neckline fastener 110 therein. Since the second neckline portion 108B is relatively thick and padded, this feature prevents the part of the neckline fastener 110 enclosed within the second neckline portion 108B from rubbing against the baby's neck, and further prevents the baby from accessing the neckline fastener 110 when the neckline fastener 110 is fastened.

The neckline fastener 110 is a device that can be fastened and unfastened to thereby close and open the neckline 108, respectively. The neckline fastener 110 includes the insertion end 110A and the receiving end 110B, the insertion end 110A being insertable into the receiving end 110B to thereby fasten the neckline fastener 110. As shown in FIGS. 2A, 2B, 3, and 4, according to an exemplary embodiment, the neckline fastener 110 is implemented as a side-release buckle strap fastener. The side-release buckle strap fastener includes an insertion end 110A that has one or several hook portions 116 that stick out, and further includes a receiving end 110B formed as a housing to receive the insertion end, the housing having openings 118 on opposite sides to catch the hook portions 116. The hook portions 116 have a certain degree of elasticity so that, when the hook portions 116 are initially inserted into the receiving end 110B, the sidewalls of the receiving end 110B press the protruding hook portions inward, and when the hook portions 116 are pressed farther inside of the receiving end 110B, the hook portions 116 encounter the openings 118 on the sidewalls and spring outwards through the openings 118 to catch the sidewalls and lock into place. The side-release buckle strap has several technical benefits, including being very easy for parents to lock and unlock, very difficult for babies to lock and unlock, and generally being a very safe design with no sharp edges.

Either one of the insertion end 110A or the receiving end 110B can be located in the second neckline portion 108B. In the example shown in FIG. 2B, the insertion end 110A of the side-release buckle strap is enclosed inside of the second neckline portion 108B, and the receiving end 110B is connected to and freely hanging from the first neckline portion 108A. In contrast, in the example shown in FIG. 3, the receiving end 110B is enclosed inside of the second neckline portion 108B, and the insertion end 110A is connected to and freely hanging from the first neckline portion 108A. The insertion end 110A and the receiving end 110B can be attached to the neckline 108 in various ways. For example, the insertion end 110A and the receiving end 110B can be sewn onto the first neckline portion 108A and second neckline portion 108B, can be buttoned into the neckline 108, etc. Also, the neckline fastener 110 may be manufactured as an elastic strap or other material that has the insertion end 110 and receiving end 110B located at opposite ends thereof, in which case the neckline fastener 110 can be sewn inside of the neckline 108 so that only the insertion end 110A and receiving end 110B are exposed. Many different configurations of the neckline fastener 110 are possible.

The zipper locking mechanism 106 locks the zipper 104 to the neckline fastener 110. According to an exemplary embodiment, the zipper locking mechanism 106 is implemented as a loop of material (also referred to as a "loop") that is connected to the zipper 104 and that loops around one end of the neckline fastener 110 when the neckline fastener 110 is unfastened and then is locked into place when the neckline fastener 110 is fastened. The loop can be made out of many different types of materials, such as string, rubber, or other materials. In certain exemplary embodiments, the loop is made out of rubber and functions as both a zipper pull and a zipper locking mechanism. The loop can be a fixed size or can be adjustable, and can have additional smaller loops or other shapes formed therein to help a user grip the loop. In the example shown in FIG. 3, the loop connects to the slider 104A of the zipper 104. Also, the slider 104A and the loop can both be formed out of rubber, so that the rubber loop and rubber slider 104A collectively form a rubber zipper. In this case, the rubber slider 104A and the rubber loop can be separately formed and connected together, or can be integrally formed from a single piece of rubber as one unit.

The zipper locking mechanism 106 achieves several technical benefits not achieved by the related art. First, the zipper locking mechanism 106 very securely locks the zipper 104 into place. Specifically, when the loop is wrapped around the neckline fastener 110 and the neckline fastener 110 is fastened closed, it is nearly impossible for a baby to unlock the zipper 104 in such a state. In contrast, many of the related art configurations simply disclose using snaps, which can easily be pulled open by babies. Second, the zipper locking mechanism 106 has a simple and effective design that can easily be locked and unlocked by parents. In contrast, the conventional baby onesies have multiple flaps, snaps, and/or pockets that may be quite difficult for parents to operate, especially with a fidgety baby. Third, the zipper 104 is automatically unlocked in response to opening the neckline fastener 110, which improves convenience. Fourth, if the baby tries to pull the zipper 104 open when the loop is secured to the neckline fastener 110, the baby will end up pulling the back of the baby's own neckline 108, which may be uncomfortable. Thus, the zipper locking mechanism 106 also functions as a deterrence mechanism, which deters the baby from trying to unlock the zipper 104. Fifth, since the second neckline portion 108B is a relatively thick and soft piece of material, the neckline fastener 110 and zipper locking mechanism 106 do not irritate the baby when in a fastened position.

The grippy feet 112 are high-friction materials (e.g., rubber, etc.) that are formed on the soles of the foot portions 102F and 102G of the respective leg covering portions 102A and 102B. The grippy feet 112 help babies grip their feet against the ground to assist in learning to walk. The grippy feet 112 can be designed in many different patterns, shapes, and sizes, and exemplary embodiments are not limited to any particular arrangement.

The fold-over hands 114 are portions of material located at the end of the arm covering portions 102C and 102D, respectively, that can be folded up to expose the baby's hands and folded back down to cover the baby's hands. At certain early developmental stages, such as the newborn stage, parents may prefer to cover the baby's hands at night, and then expose the baby's hands during the day. The fold-over hands 114 can be used to achieve this objective. The fold-over hands 114 can be many different types and styles, and can have various optional features, e.g., buttons, etc., to keep the fold-over hands 114 folded up.

As shown in FIGS. 3 and 4, the locking mechanism operates as follows. FIG. 3 illustrates the locking mechanism in an unlocked state and FIG. 4 illustrates the locking mechanism in a locked state. First, as shown in FIG. 3, the onesie 100 is fully or partially open (i.e., unzipped) such that the zipper 104 is pulled down the track 105 and the teeth in the track 105 are separated from each other. The insertion end 110A of the neckline fastener 110 is detached from the receiving end 110B of the neckline fastener 110.

Once the parent puts the baby into the onesie 100, the parent pulls the zipper 104 up the track 105 using the zipper locking mechanism 106 as the zipper pull. As the zipper 104 is pulled up the track 105, the teeth of the track 105 interlock with each other to close the onesie 100. Then, the parent wraps the zipper locking mechanism 106 (which is a loop in FIG. 4) around the insertion end 110A of the neckline fastener 110. Then, the parent inserts the insertion end 110A into the receiving end 110B. At this point, the zipper locking mechanism 106 is locked into place around the neckline fastener 110, thus locking the zipper 104 into place.

Figure 5A:
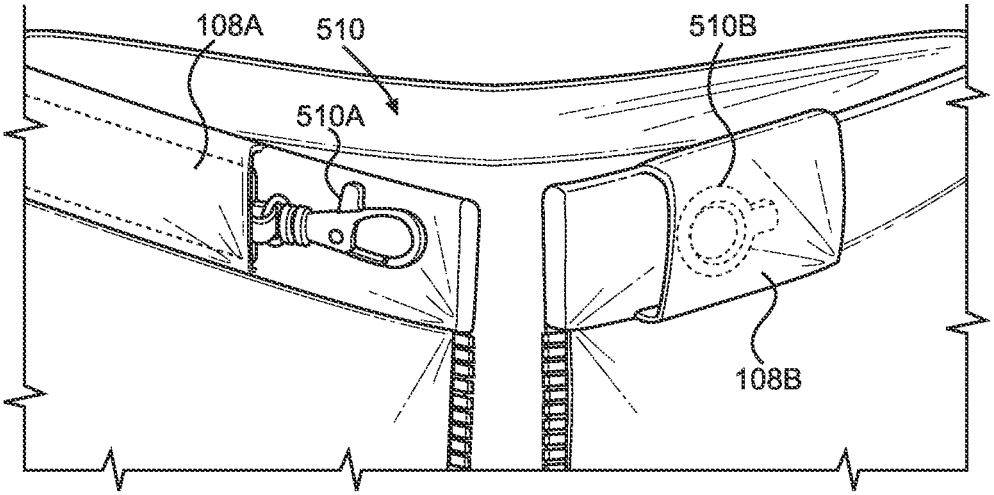
FIGS. 5A, 5B, 5C, 5D, and 5E are views of neckline fasteners according to other exemplary embodiments.
Figure 5B:
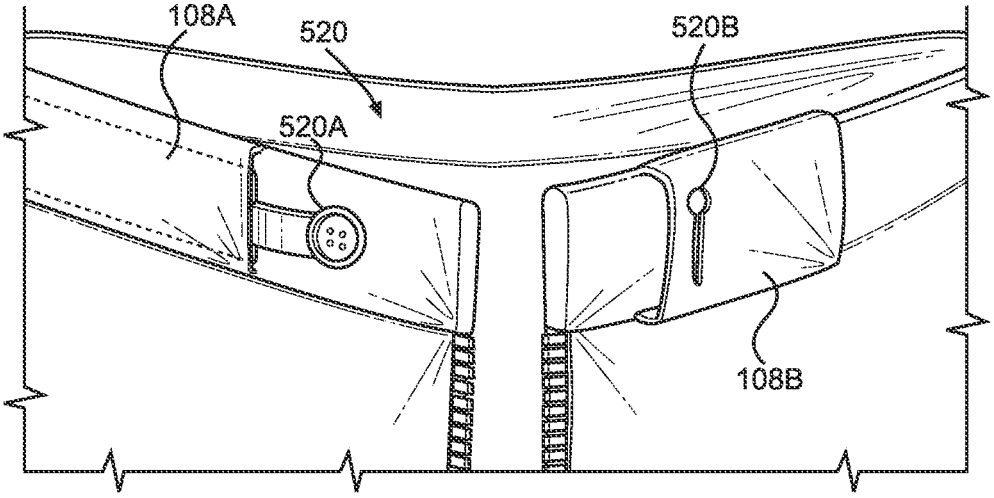
Figure 5C:
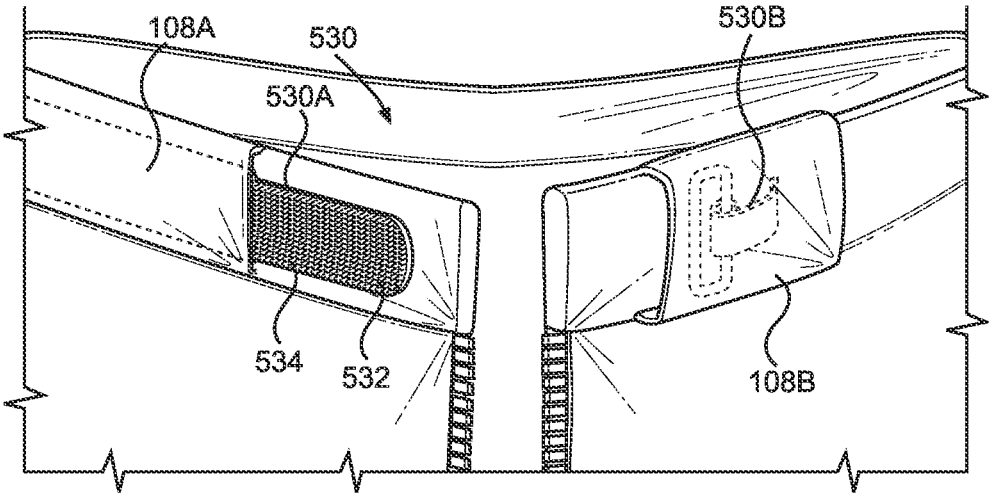
Figure 5D:
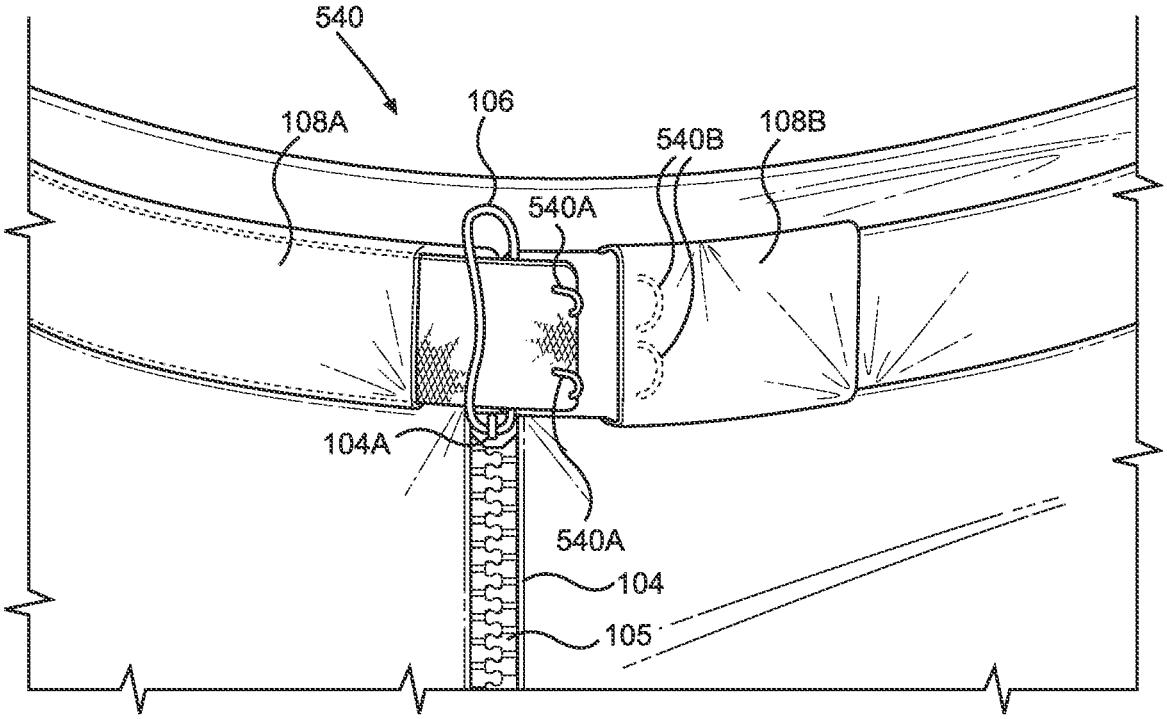
Figure 5E:
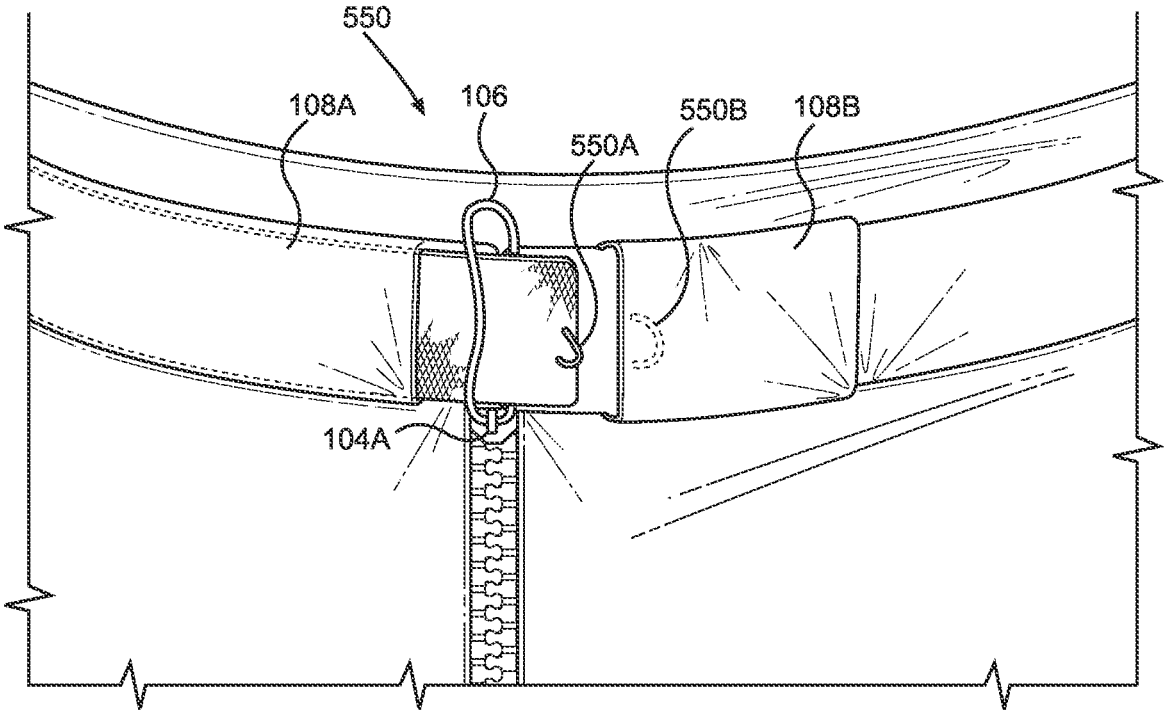

5A, 5B, 5C, 5D, and 5E illustrate neckline fasteners according to other exemplary embodiments. FIG. 5A illustrates a neckline fastener that is implemented as a swivel lobster claw clasp fastener 510. FIG. 5B illustrates a neckline fastener that is implemented as a button fastener 520. FIG. 5C illustrates a neckline fastener that is implemented as a VELCRO® strap fastener 530. FIG. 5D illustrates a neckline fastener that is implemented as a plurality of small hook and eye latches 540. FIG. 5E illustrates a neckline fastener that is implemented as a single large hook and eye latch 550. In FIGS. 5A-5E, certain components are illustrated with dotted lines to show that they are embedded inside of the second neckline portion 108B.

As shown in FIG. 5A, the neckline fastener that is implemented as a swivel lobster claw clasp fastener 510 includes an insertion end that is the swivel lobster claw clasp 510A, and further includes a receiving end that is a loop 510B enclosed within the second neckline portion 108B. The swivel lobster claw clasp 510A is clasped around the loop 510B to fasten the neckline fastener 510. The swivel lobster claw clasp 510A can swivel about an axis (the axis being the horizontal direction in FIG. 5A), which achieves the technical benefit that it may be very easy for parents to fasten and unfasten the swivel lobster claw clasp, especially when dealing with a fidgety baby. Moreover, since the swivel lobster claw clasp 510A is hidden in the thicker second neckline portion 108B when fastened, it is difficult for the baby to unlock the swivel lobster claw clasp 510A.

As shown in FIG. 5B, the neckline fastener that is implemented as a button fastener 520 includes an insertion end that is a button 520A and a receiving end that is a slot 520B into which the button 520A can be inserted. The button fastener 520 achieves the technical benefit that the button is relatively small and unobtrusive, and thus, may be preferable for babies that are bothered by bigger neckline fasteners. Moreover, it would be extremely difficult or impossible for a baby to unbutton the button fastener 520.

As shown in FIG. 5C, the neckline fastener that is implemented as a VELCRO® strap fastener 530 includes an insertion end that is a VELCRO® strap 530A and a receiving end that is a bracket 530B. The VELCRO® strap 530A is a long thin strip of material including VELCRO® or some other similar material having tiny hooks 532 on at least one part thereof and tiny loops 534 on at least one other part thereof, the hooks 532 catching onto and locking onto the loops 534. In the example shown in FIG. 5C, the hooks 532 are located on an end part of the VELCRO® strap 530A and the loops 534 are located on a part of the strap 530A that is closest to the first neckline portion 510A, although exemplary embodiments are not limited thereto. To fasten the VELCRO® strap fastener 520, the parent passes the part of the strap 530A having the hooks 532 through the bracket 530B and then folds the same portion of the strap 530A back over the bracket 530B and presses the hooks 532 onto the loops 534. The VELCRO® strap fastener 520 achieves the technical benefit that it is extremely easy to adjust the tightness of the fastener 520, by adjusting the length of the strap 530A that is pressed through the bracket 530B.

As shown in FIG. 5D, the neckline fastener that is implemented as a plurality of small hook and eye latches 540 includes an insertion end that is a plurality of small hooks 540A and a receiving end that is a corresponding plurality of small eyes 540B. Each of the small hooks 540A can be hooked into a respective one of the small eyes 540B, to thereby close the neckline 108. The neckline fastener including the plurality of small hook and eye latches 540 achieves the technical benefit that it is extremely simple and easy to open and close the neckline 108. Although FIG. 5D illustrates two hooks 540A, it is understood that more than two hooks 540A may be used. Moreover, the hooks 540A are shown relatively large for illustrative purposes, but the sizes of the hooks 540A may be smaller than those shown in FIG. 5D.

As shown in FIG. 5E, the neckline fastener that is implemented as a single large hook and eye latch 550 includes an insertion end that is a single large hook 550A and a receiving end that is a large eye 550B. The large hook 550A can be hooked into the large eye 550B, to thereby close the neckline 108. The neckline fastener including the large hook and eye latch 550 shown in FIG. 5E achieves similar technical benefits as those achieved by the neckline fastener including the plurality of small hook and eye latches 540 shown in FIG. 5D.

Figure 6A:
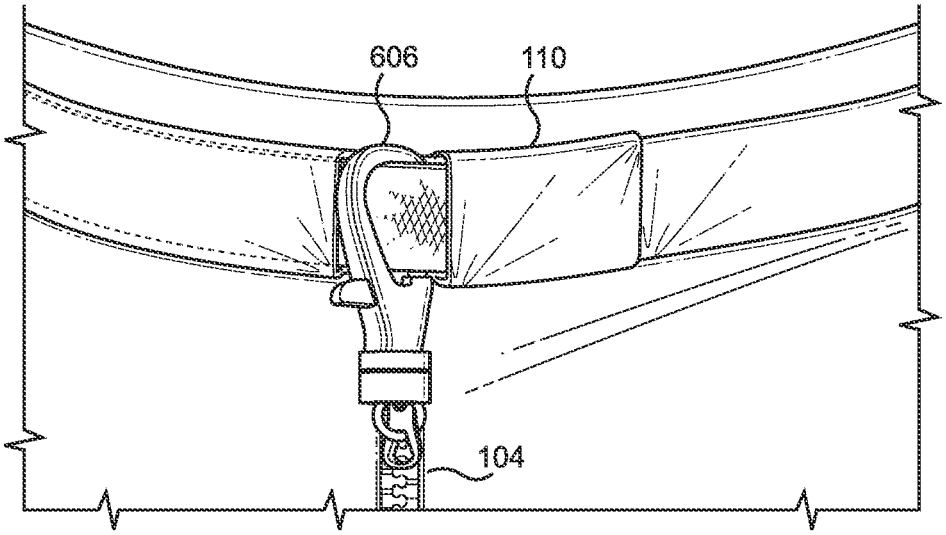
FIGS. 6A, 6B, and 6C are views of zipper locking mechanisms according to other exemplary embodiments.
Figure 6B:
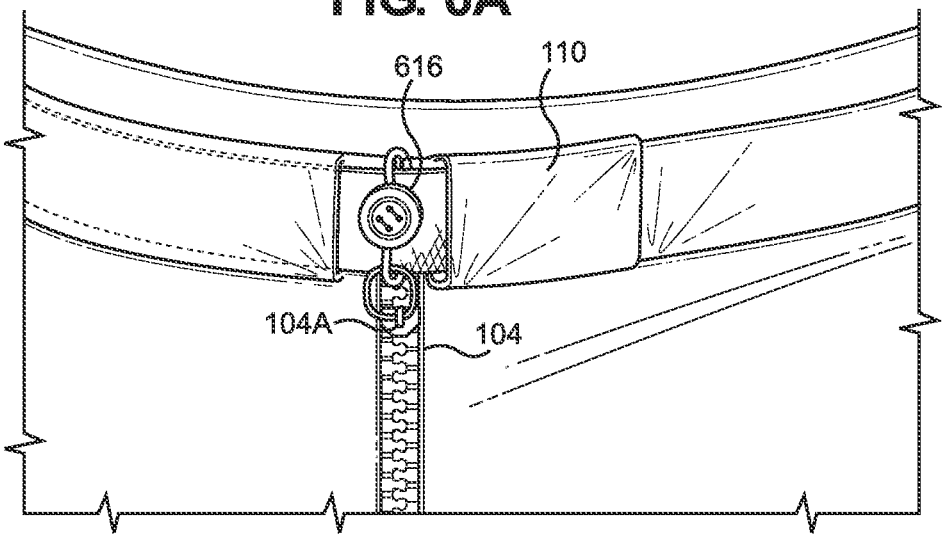
Figure 6C:
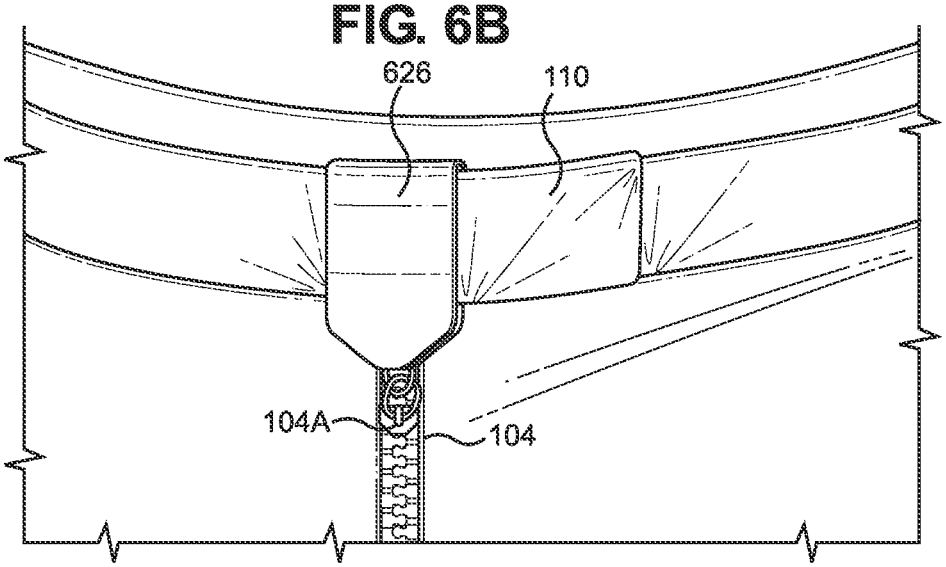

FIGS. 6A, 6B, and 6C are zipper locking mechanisms according to other exemplary embodiments. FIG. 6A illustrates a zipper locking mechanism that is implemented as a swivel lobster claw clasp locking mechanism 606. FIG. 6B illustrates a zipper locking mechanism that is implemented as a button locking mechanism 616. FIG. 6C illustrates a zipper locking mechanism that is implemented as a VELCRO® strap locking mechanism 626.

As shown in FIG. 6A, the swivel lobster claw clasp locking mechanism 606 is a swivel lobster claw clasp connected to the zipper 104. The swivel lobster claw clasp locking mechanism 606 clasps around the neckline fastener 110 to thereby lock the zipper 104 in place.

As shown in FIG. 6B, the button locking mechanism 616 is a button attached to a thin strip of material that is in turn connected to the zipper 104. The thin strap of material can have a slot formed therein, and the button can be passed through the slot to thereby button the thin strip of material around the neckline fastener 110 to thereby lock the zipper 104 in place.

As shown in FIG. 6C, the VELCRO® strap locking mechanism 626 is a VELCRO® strap that is connected to the zipper 104. The VELCRO® strap can be wrapped around the neckline fastener 110 to thereby lock the zipper 104 in place.

Figure 7:
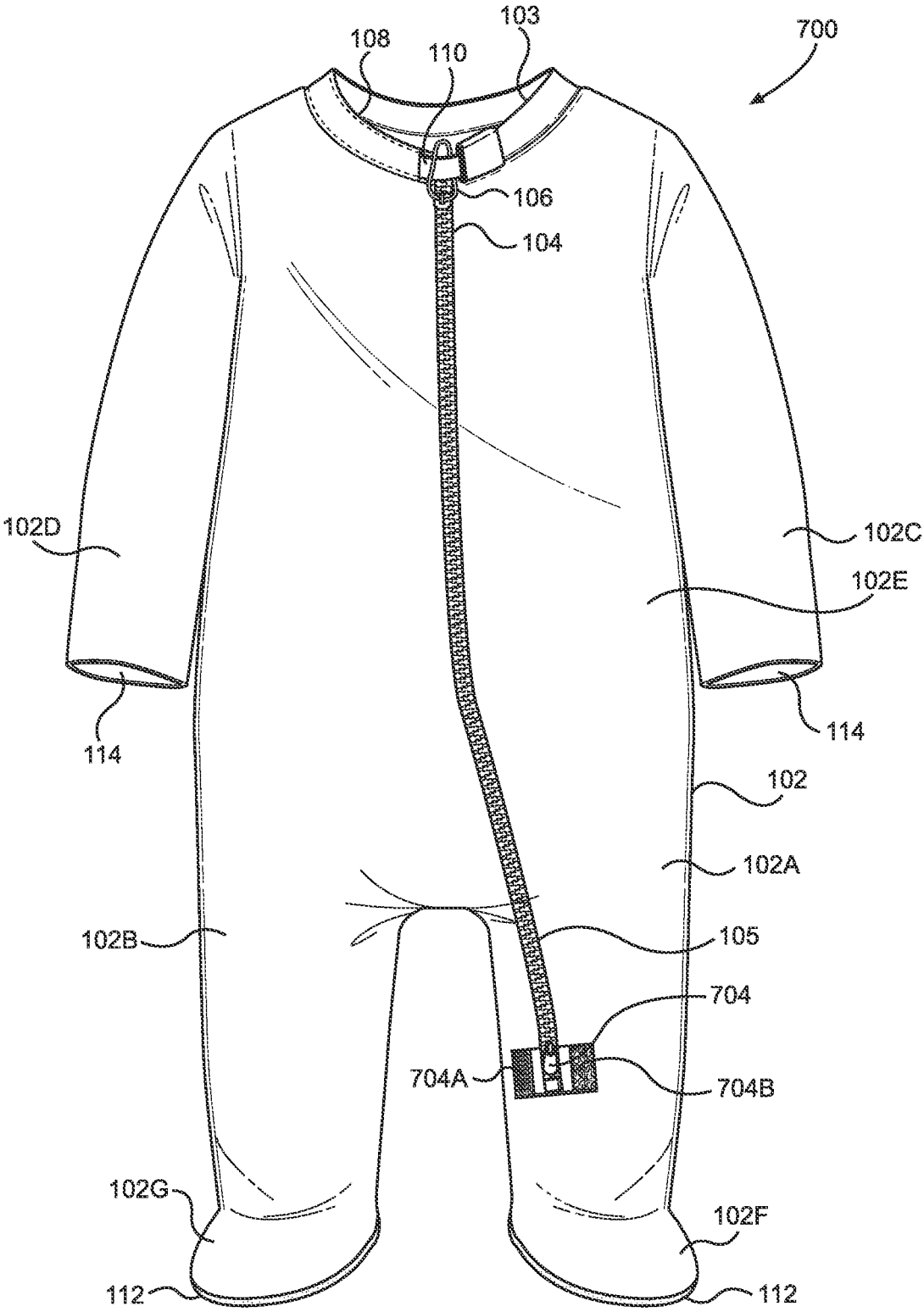
FIG. 7 is a front view of a baby onesie having a double zipper option according to another exemplary embodiment.

FIG. 7 is a front view of a baby onesie having a double zipper option according to another exemplary embodiment. As shown in FIG. 7, the baby onesie 700 having the double zipper option includes each of the components of the baby onesie 100 shown in FIG. 1, and further includes a second zipper 704 that can be used to zip open the baby onesie 100 from the bottom part of the baby onesie 700. In FIG. 7, the second zipper 704 is configured to open the baby onesie 700 from the bottom of first leg covering portion 102A, although exemplary embodiments are not limited thereto. The second zipper 704 and the first zipper 104 are both fixed on and share the same track 105. The second zipper 704 may have the same constituent parts as the first zipper 104, including a slider. The second zipper 704 may be a rubber zipper. Also, the baby onesie 700 includes a protective VELCRO® flap including a first part 704A that can be folded over and attached to a second part 704B using VELCRO® fastening material (or something similar) provided on the surfaces thereof. The protective VELCRO® flap covers the second zipper 704 to prevent a baby from accessing the second zipper 704. The baby onesie 700 with the double zipper option shown in FIG. 7 achieves the technical benefit that, by providing the second zipper 704, parents can easily access the legs and torso of a baby without needing to fully undress the baby, which can be especially useful in certain situations, such as changing diapers in the middle of the night.

Figure 8:
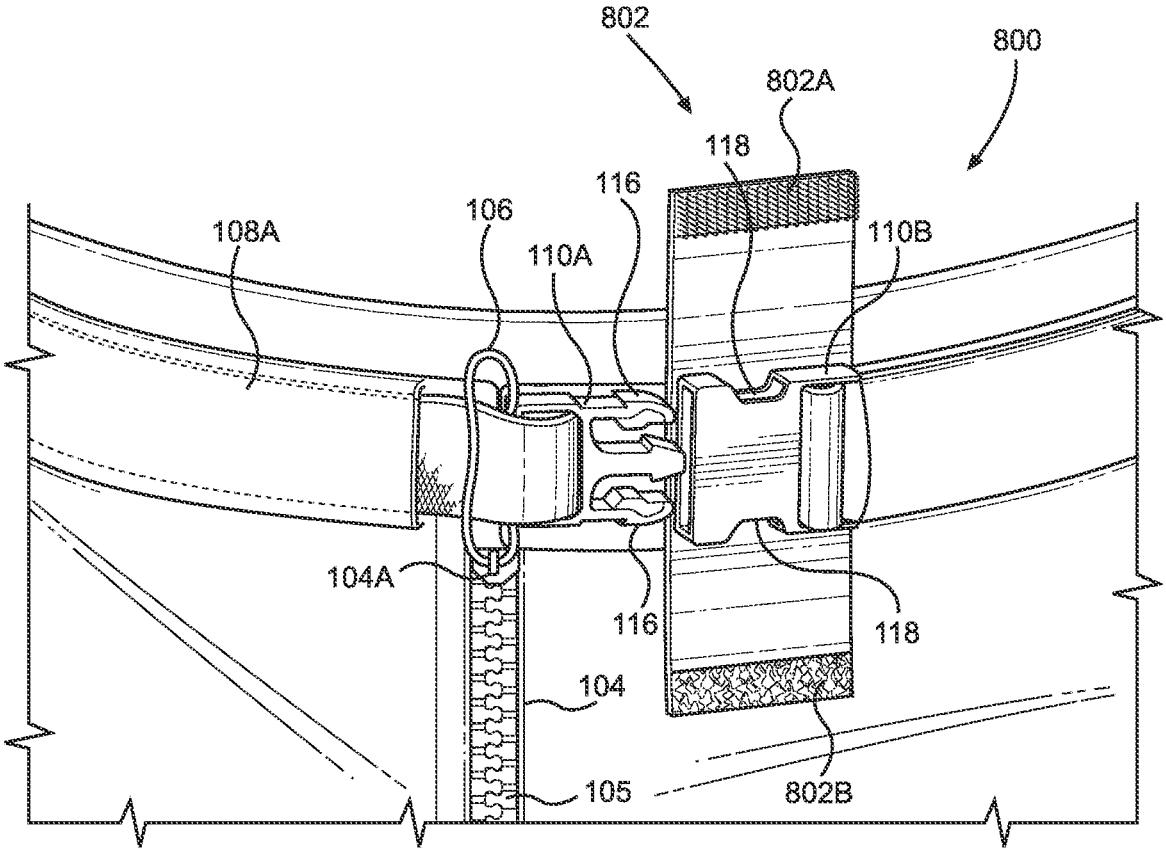
FIG. 8 is a view of a neckline fastener arrangement including a VELCRO® flap according to another exemplary embodiment.

FIG. 8 is a close-up view of a neckline fastener arrangement including a VELCRO® flap according to another exemplary embodiment. As shown in FIG. 8, the neckline fastener arrangement 800 includes the VELCRO® flap 802 which includes a first part 802A that can be folded over and connected to a second part 802B using VELCRO® (or similar material) that is provided on surfaces of the first part 802A and 802B. In contrast to the second neckline portion 108B shown in FIG. 3 which includes a pocket to enclose part of the neckline fastener, the neckline fastener arrangement 800 includes the VELCRO® flap which can be wrapped and unwrapped around part of the neckline fastener. In the example shown in FIG. 8, the neckline fastener is implemented as the side-release buckle strap 110 (see FIG. 3) and includes the insertion end 110A having hook portions 116 and the receiving end 110B having openings 118 on opposite sides thereof to catch the hook portions 116. However, the neckline fastener arrangement 800 is not limited to using the side-release buckle strap 110 as the neckline fastener, and instead, the neckline fastener arrangement 800 may be used in combination with any of the other neckline fasteners shown and described above, including the swivel lobster claw clasp fastener 510 (FIG. 5A), the button fastener 520 (FIG. 5B), the VELCRO® strap fastener 530 (FIG. 5C), the plurality of small hook and eye latches 540 (FIG. 5D), or the single large hook and eye latch 550 (FIG. 5E).

Figure 9:
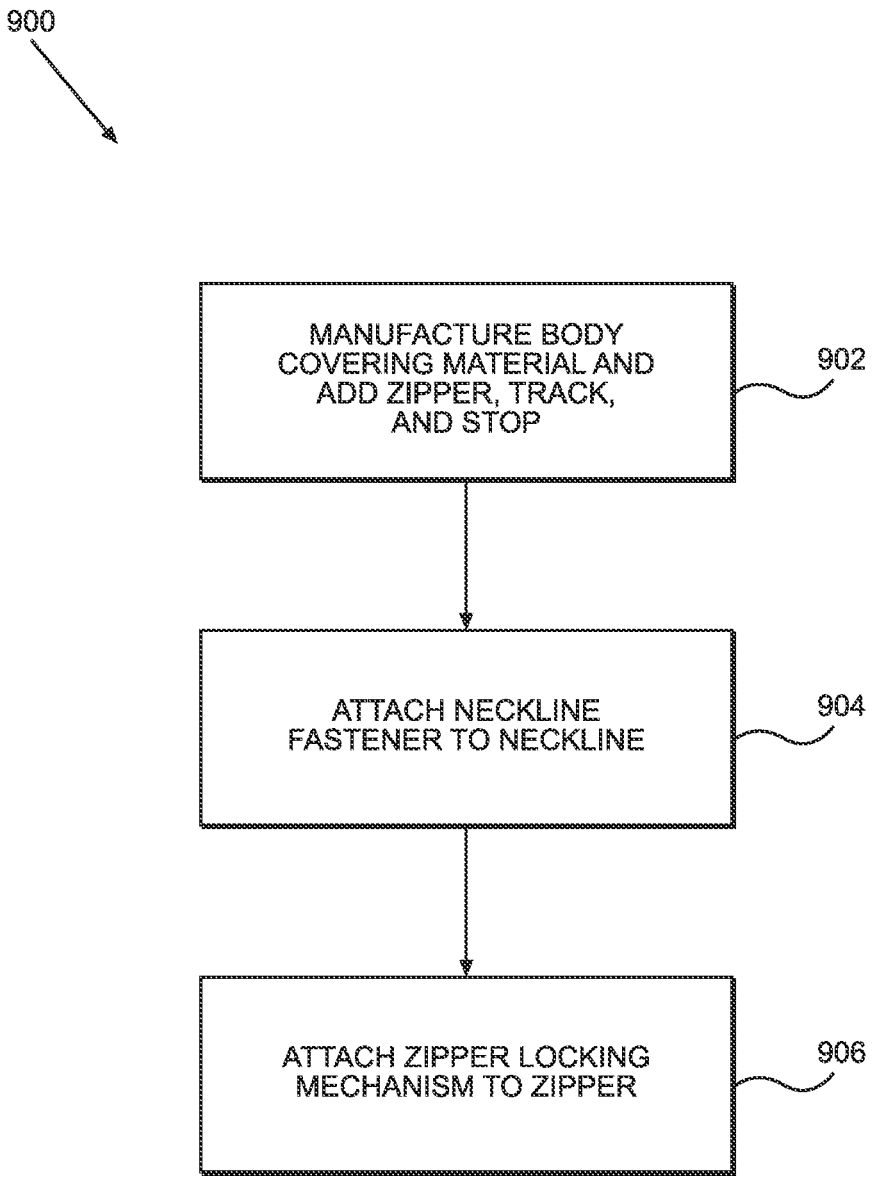
FIG. 9 is a method of manufacturing a baby onesie having a zipper locking mechanism, according to an exemplary embodiment.

FIG. 9 illustrates a method of manufacturing a baby onesie having a zipper locking mechanism, according to an exemplary embodiment. The method 900 shown in FIG. 9 is exemplarily described as a method to manufacture the baby onesie 100 shown in FIG. 1. However, it is understood that the method 900 can also be used to manufacture baby onesies according to other exemplary embodiments (e.g., baby onesies having various combinations of zipper locking mechanisms and neckline fasteners).

In operation 902, the body covering material 102 is manufactured and the zipper, track, and stop are added. There are many different ways to manufacture the body covering material 102. If the body covering material 102 is manufactured from raw materials such as cotton in a textile factory, then the body covering material 102 will typically be manufactured using a spinning process which converts the raw materials into thread and a weaving process which weaves the thread into fabric. Alternatively, operation 902 may include cutting the final onesie shape from a large pre-formed sheet of material using machinery. As another alternative, the operation 902 may include hand-sewing the body covering material. Operation 902 includes assembling together each of the parts of the body covering material 102, including leg covering portions 102A, 102B, arm covering portions 102C, 102D, a torso covering portion 102E, a neckline 108, a zipper 104, a track 105, and a stop 107. Also, optional features such as the grippy feet 112 and fold over hands 114 can be added to the body covering material 102 during operation 702.

In operation 904, the neckline fastener 110 is attached to the neckline. For example, when the neckline fastener 110 is the side-release buckle strap fastener, operation 904 includes attaching the insertion end 110A to the first neckline portion 108A, and attaching the receiving end 110B inside of the thicker second neckline portion 108B. The insertion end 110A and receiving end 110B can be attached to the respective neckline portions 108A and 108B using various techniques, such as sewing, fastening with fasteners, etc.

In operation 906, the zipper locking mechanism 106 (e.g., a loop of material) is attached to the zipper (e.g., zipper 104). The zipper locking mechanism 106 can be attached to the zipper 104 in various ways. For example, as shown in FIG. 3, the zipper locking mechanism 106 can be attached to the slider 104A using fasteners, such as pins, screws, etc. For example, if the zipper 104 is rubber, the rubber loop can be attached to the slider. Once the zipper locking mechanism 106 is attached to the zipper 104, the baby onesie with the zipper locking mechanism is fully manufactured and ready for use.

It is further noted that the order of operations for method 900 is not limited to the order shown in FIG. 9. For example, operations 904 and 906 can be switched, so that the zipper locking mechanism is attached to the zipper first, and the neckline fastener is then attached to the neckline afterwards.

Also, it is noted that the locking mechanism and neckline fastener may be sold separately from the baby onesie. For example, the locking mechanism and neckline fastener may be sold as a combination item that can be purchased by parents and attached to a baby onesie that the parents previously purchased. In this case, operation 902 may be omitted from the method 900.

Figure 10:
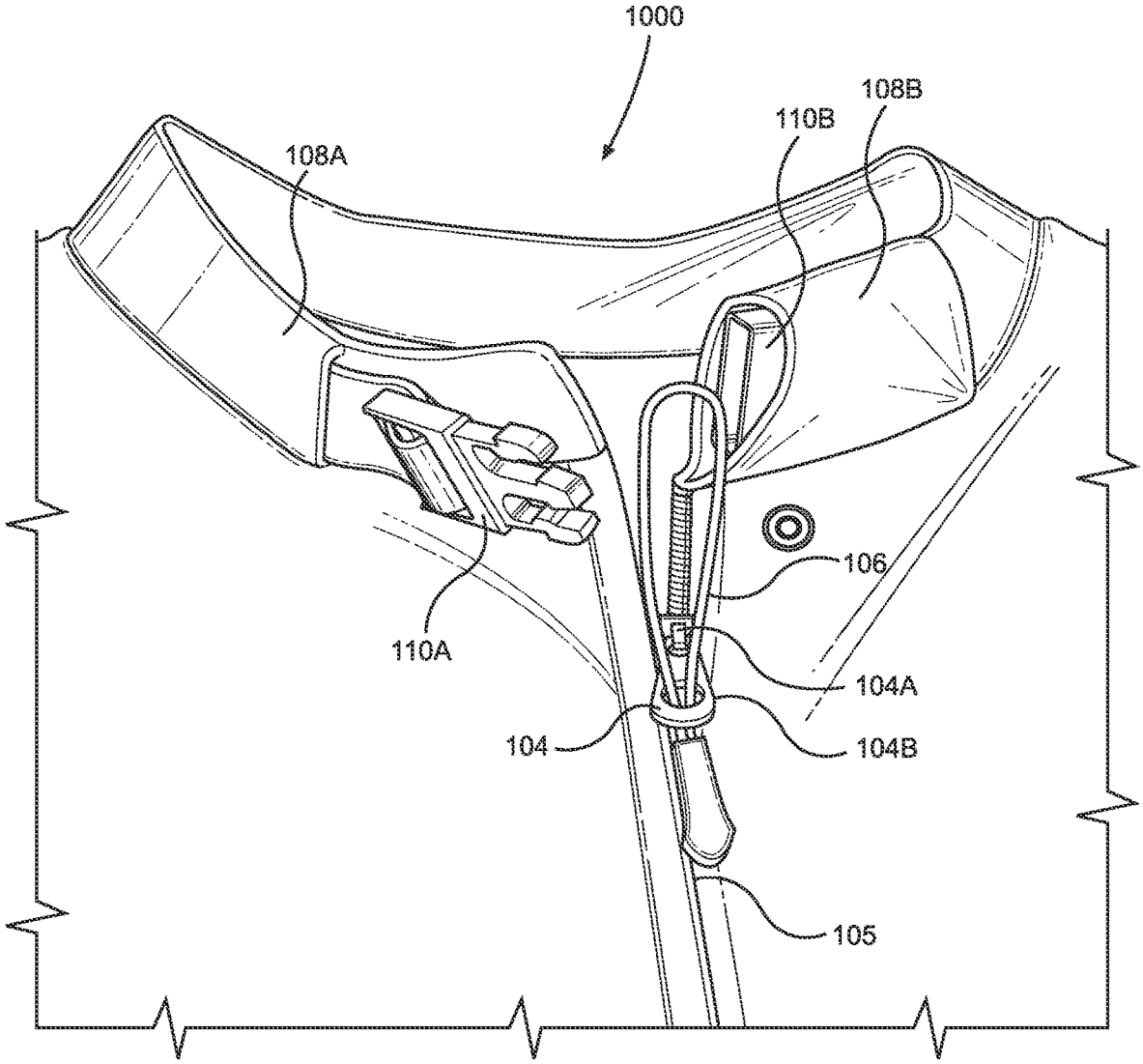
FIG. 10 is a view of a zipper locking mechanism according to another exemplary embodiment.

FIG. 10 is a view of a zipper locking mechanism according to another exemplary embodiment. As shown in FIG. 10, the zipper locking mechanism 1000 is similar to the zipper locking mechanism shown in FIG. 1, except that the zipper locking mechanism 1000 includes a pull 104B that is separate from the zipper locking mechanism 106. The pull 104B has a wider shape with a curved edge towards an outer section thereof and sides that taper inwards towards the slider 104A. The pull 104B is connected to the slider 104A at one end thereof and is further connected to the zipper locking mechanism 106 at the other end thereof. The pull 104B may be made of metal, plastic, rubber, or any other material of combination of materials. In the example shown in FIG. 10, the pull 104B has an opening formed in the wider part thereof, and ends of the zipper locking mechanism 106 (which is a loop of rubber in this case) are pulled through the opening and connected together to fix the zipper locking mechanism 106 to the pull 104B. It is understood that the pull 104B is not limited to the specific shape and configuration shown in FIG. 10, and can instead be designed to have many other shapes and configurations. Moreover, it is understood that the zipper locking mechanism 1000 can be combined with any of the other exemplary embodiments previously described.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments. Any of the different combinations of neckline fasteners and zipper locking mechanisms can be combined with each other. For example, the baby onesie can be manufactured to have the combination of the loop zipper locking mechanism 106 and the VELCRO® strap fastener 530, the combination of the button locking mechanism 616 and the side-release buckle strap fastener 110, or any other combinations.

Moreover, the exemplary embodiments are not limited to the neckline fasteners described above and shown in FIGS. 1-5E. Instead, the neckline fastener according to exemplary embodiments can be any type of fastening device that is capable of fastening the neckline of the baby onesie. For example, the neckline fastener can include a drawstring, a zipper, pins, various types of clasps and buckles, or any other fastening device that can safely and securely fasten the neckline of the baby onesie. Depending on the type of neckline fastener being used, the neckline fastener can be made of many different types of materials. For example, when the neckline fastener is implemented as the side-release buckle strap fastener or some other kind of buckle or clasp, the neckline fastener can be made of plastic, metal, some combination thereof, or some other material altogether. Moreover, when the neckline fastener includes a drawstring, the neckline fastener can be made of various types of fabrics, e.g., cotton, polyester, nylon, etc.

Also, the exemplary embodiments are not limited to the types of zipper locking mechanisms described above and shown in FIGS. 1-4 and 6A-6C. Instead, the zipper locking mechanisms according to exemplary embodiments can be any type of locking mechanism that is capable of locking the zipper 104 to the neckline 108. For example, the zipper locking mechanism can include various types of clasps and buckles, hooks, or any other device that can lock the zipper to the neckline (or other part of the baby onesie 100) to thereby prevent the zipper from moving when the baby onesie is closed. The locking mechanism can be made of many different types of materials, such as fabrics, plastic, metal, some combination thereof, or some other material altogether.

While one or more exemplary embodiments have been described with reference to the figures, it will be understood by those of ordinary skill in the art that various changes in form and details may be made therein without departing from the spirit and scope as defined by the following claims.

What is claimed is:

1. A method, comprising:

providing an article of clothing, the article of clothing comprising a body portion having a first leg covering portion, a second leg covering portion, a first arm covering portion, a second arm covering portion, and a torso covering portion, the body portion further having a neckline defining a neckline opening, the neckline having a neckline fastener movable between a fastened state and an unfastened state to close and open the neckline, the article of clothing further comprising a zipper track having a zipper track first end at the neckline and a zipper track second end within the first leg covering portion, the zipper track extending through the torso covering portion;

unzipping via a zipper pull of a zipper associated with the zipper track to reveal a zipper opening extending from the neckline, the zipper pull being in the form of a loop;

inserting legs of a wearer into the first and second leg covering portions via the zipper opening;

inserting a torso of the wearer into the torso covering portion via the zipper opening;

inserting arms of the wearer into the first and second arm covering portions via the zipper opening;

moving the zipper via the zipper pull to the zipper track first end to close the zipper opening, the zipper being in a closed position when the zipper opening is closed;

passing an insertion end of the neckline fastener through the zipper pull such that the loop of the zipper pull wraps completely around the insertion end; and fastening the neckline fastener to close the neckline, wherein fastening the neckline fastener includes locking the zipper in the closed position, the fastening including inserting the insertion end into a receiving end of the neckline fastener subsequent to the passing of the loop around the insertion end, the insertion end being passed through the loop to the receiving end in a direction that is generally parallel to a neck of the user and perpendicular to movement of the zipper.

2. The method of claim 1, wherein the article of clothing is a babies onesie.

3. The method of claim 1, wherein the neckline fastener includes a swivel lobster claw clasp fastener, a hook and loop fastener, a hook and eye latch, or a buckle.

4. The method of claim 1, wherein the passing of the insertion end locks the zipper in the closed position.

5. The method of claim 1, wherein the zipper pull has an opening, and wherein passing the insertion end through the opening of the zipper pull locks the zipper in the closed position.

6. The method of claim 1, wherein the neckline includes a first end and a second end, wherein fastening the neckline fastener includes fastening the first end to the second end.

7. The method of claim 6, wherein the neckline includes a flap positioned to cover at least one of the first end and the second end when the neckline fastener is in the fastened state.

8. The method of claim 7, wherein fastening the neckline opening includes moving the flap from a position not covering the at least one of the first end and the second end to a position covering the at least one of the first end and the second end.

9. The method of claim 6, wherein the second end includes a region of padded material to prevent the neckline fastener from contacting skin of the wearer when the wearer is wearing the article of clothing and the neckline fastener is in the fastened state.

10. The method of claim 6, wherein the second end includes a covering portion, the neckline fastener being covered by the covering portion when the neckline fastener is in the fastened state.

11. The method of claim 1, further comprising unfastening the neckline fastener, wherein unfastening the neckline fastener automatically unlocks the zipper from the closed position.

12. The method of claim 1, further comprising applying an unzipping force on the locked zipper, wherein applying the unzipping force on the locked zipper disperses the unzipping force through the neckline to a neck of the wearer.

13. The method of claim 12, further comprising:

unfastening the neckline fastener, wherein unfastening the neckline fastener automatically unlocks the zipper from the closed position; and applying an additional unzipping force on the unlocked zipper, wherein applying the additional unzipping force unzips the zipper.

14. A method, comprising:

providing an article of clothing, the article of clothing comprising a body portion having a first leg covering portion, a second leg covering portion, a first arm covering portion, a second arm covering portion, and a torso covering portion, the body portion further having a neckline defining a neckline opening, the neckline having a neckline fastener movable between a fastened state and an unfastened state to close and open the neckline, the article of clothing further comprising a zipper track having a zipper track first end at the neckline and a zipper track second end within the first leg covering portion, the zipper track extending through the torso covering portion;

unzipping via a zipper pull a zipper associated with the zipper track to reveal a zipper opening extending from the neckline;

terminating the unzipping, via the zipper pull, at a zipper stop located at the zipper track second end, the zipper stop being unobscured for ease of user access to the zipper pull;

inserting legs of a wearer into the first and second leg covering portions via the zipper opening;

inserting a torso of the wearer into the torso covering portion via the zipper opening;

inserting arms of the wearer into the first and second arm covering portions via the zipper opening;

moving the zipper via the zipper pull to the zipper track first end to close the zipper opening, the zipper being in a closed position when the zipper opening is closed;

passing an insertion end of the neckline fastener through the zipper pull such that a loop of the zipper pull wraps completely around the insertion end and fastening the neckline fastener to close the neckline, wherein fastening the neckline fastener includes locking the zipper in the closed position, the fastening including inserting the insertion end into a receiving end of the neckline fastener subsequent to the passing of the loop around the insertion end, the insertion end being passed through the loop to the receiving end in a direction that is generally parallel to a neck of the user and perpendicular to movement of the zipper.

15. The method of claim 14, wherein the zipper pull is a sole zipper pull along the zipper track.

16. The method of claim 14, wherein the article of clothing is a babie onesie.

17. The method of claim 14, wherein the neckline fastener includes a swivel lobster claw clasp fastener, a hook and loop fastener, a hook and eye latch, or a buckle.

18. A method comprising:

providing a baby onesie to be worn by a baby, the baby onesie including:

a body covering material comprising a neckline opening, leg covering portions, arm covering portions, and a torso covering portion, a neckline provided around a perimeter of the neckline opening, the neckline comprising a first neckline portion and a second neckline portion, the second neckline portion comprising a tubular member disposed along a portion of a length of the neckline, the tubular member having at least one open end, a neckline fastener coupled to the neckline and disposable between a fastened state and an unfastened state to thereby close and open the neckline, respectively, the neckline fastener comprising an insertion end connected to the first neckline portion and a receiving end connected to the second neckline portion, the receiving end being at least partially enclosed within the tubular member of the second neckline portion, wherein the insertion end is received by the receiving end when the neckline fastener is in the fastened state, and wherein, when the neckline fastener is in the fastened state, the insertion end and the receiving end are at least partially enclosed within the tubular member of the second neckline portion, a zipper coupled to the body covering material and disposable between an unzipped state and a zipped state to open and close the body covering material, respectively, and a zipper locking mechanism attached to the zipper, the zipper locking mechanism having an opening to receive the neckline fastener and at least a portion of the first neckline portion therethrough when the zipper is in the zipped state and the neckline fastener is moved into the fastened state, the zipper locking mechanism locking the zipper in the zipped state while the neckline fastener is in the fastened state, wherein movement of the neckline fastener from the fastened state to the unfastened state unlocks the zipper thus permitting the zipper to move from the zipped state to the unzipped state;

unzipping the zipper to reveal a zipper opening extending from the neckline;

inserting legs of a wearer into respective ones of the leg covering portions via the zipper opening;

inserting a torso of the wearer into the torso covering portion via the zipper opening;

inserting arms of the wearer into the respective ones of the arm covering portions via the zipper opening;

moving the zipper via the zipper pull to the zipper track first end to close the zipper opening, the zipper being in a closed position when the zipper opening is closed; and fastening the neckline fastener to close the neckline, wherein fastening the neckline fastener includes locking the zipper in the closed position.

19. The method of claim 18, wherein the neckline fastener includes a swivel lobster claw clasp fastener, a hook and loop fastener, a hook and eye latch, or a buckle.

20. The method of claim 18, wherein the passing of the insertion end locks the zipper in the closed position.

21. The method of claim 18, wherein the zipper pull has an opening, and wherein passing the insertion end through the opening of the zipper pull locks the zipper in the closed position.

22. The method of claim 18, wherein the neckline includes a first end and a second end, wherein fastening the neckline fastener includes fastening the first end to the second end.

23. The method of claim 22, wherein the neckline includes a flap positioned to cover at least one of the first end and the second end when the neckline fastener is in the fastened state.

24. The method of claim 23, wherein fastening the neckline opening includes moving the flap from a position not covering the at least one of the first end and the second end to a position covering the at least one of the first end and the second end.

25. The method of claim 22, wherein the second end includes a region of padded material to prevent the neckline fastener from contacting skin of the wearer when the wearer is wearing the article of clothing and the neckline fastener is in the fastened state.

26. The method of claim 22, wherein the second end includes a covering portion, the neckline fastener being covered by the covering portion when the neckline fastener is in the fastened state.

27. The method of claim 18, further comprising unfastening the neckline fastener, wherein unfastening the neckline fastener automatically unlocks the zipper from the closed position.

28. The method of claim 18, further comprising applying an unzipping force on the locked zipper, wherein applying the unzipping force on the locked zipper disperses the unzipping force through the neckline to a neck of the wearer.

29. The method of claim 28, further comprising:

unfastening the neckline fastener, wherein unfastening the neckline fastener automatically unlocks the zipper from the closed position; and applying an additional unzipping force on the unlocked zipper, wherein applying the additional unzipping force unzips the zipper.

* * * * *